United States Patent [19]

Tibbitts et al.

[11] Patent Number: 5,004,057

[45] Date of Patent: Apr. 2, 1991

[54] DRILL BIT WITH IMPROVED STEERABILITY

[75] Inventors: Gordon A. Tibbitts, Salt Lake City; Mark L. Jones, Midvale, both of Utah

[73] Assignee: Eastman Christensen Company, Salt Lake City, Utah

[21] Appl. No.: 394,169

[22] Filed: Aug. 14, 1989

Related U.S. Application Data

[63] Continuation of Ser. No. 146,290, Jan. 20, 1988, abandoned.

[51] Int. Cl.[5] ..... E21B 10/46

[52] U.S. Cl. ..... 175/408; 175/415

[58] Field of Search ..... 175/61, 73, 329, 394, 175/408, 414, 415

[56] References Cited

U.S. PATENT DOCUMENTS

| | | | |
|---|---|---|---|
| 2,553,701 | 5/1951 | Comstock . | |
| 3,318,400 | 5/1967 | Hildebrandt | 175/329 |
| 3,367,430 | 2/1968 | Rowley | 175/385 |
| 3,825,083 | 7/1974 | Flarity et al. | 175/394 |
| 3,883,077 | 9/1974 | Lavallee | 175/325 |
| 3,978,933 | 9/1976 | Olson | 175/325 |
| 4,176,723 | 12/1979 | Arceneaux | 175/329 |
| 4,324,297 | 4/1982 | Denison | 175/61 |
| 4,385,669 | 5/1983 | Knutsen | 175/329 |
| 4,429,755 | 2/1984 | Williamson | 175/329 |
| 4,515,226 | 5/1985 | Mengel et al. | 175/329 |
| 4,602,691 | 7/1986 | Weaver | 175/329 |
| 4,676,324 | 6/1987 | Barr et al. | 175/329 |
| 4,714,120 | 12/1987 | King | 175/329 |
| 4,733,733 | 3/1988 | Bradley et al. | 175/61 |

FOREIGN PATENT DOCUMENTS

| | | | |
|---|---|---|---|
| 2190412 | 11/1987 | United Kingdom | 175/329 |

OTHER PUBLICATIONS

Eastman Christensen Co., *Bit Style Book*, section "Step-Type Bits (K-Series)", No. K851/M263, 1988.

*Primary Examiner*—Ramon S. Britts
*Assistant Examiner*—Terry Lee Melius
*Attorney, Agent, or Firm*—Arnold, White & Durkee

[57] ABSTRACT

A drill bit offering improved steerability. Drill bits include gage sections which are adapted to facilitate deflection of the bits within a borehole to facilitate navigational or directional drilling. The gage portions of the bit may be arranged in an arcuate path around a portion of the periphery of the bit. Also, the bit portions may be spaced and adapted to serve, at least in part, as fulcrums, to facilitate deflection of the bit and the bringing of gage cutting portions of the bit in contact with the sidewalls of the borehole.

6 Claims, 2 Drawing Sheets

Fig. 1
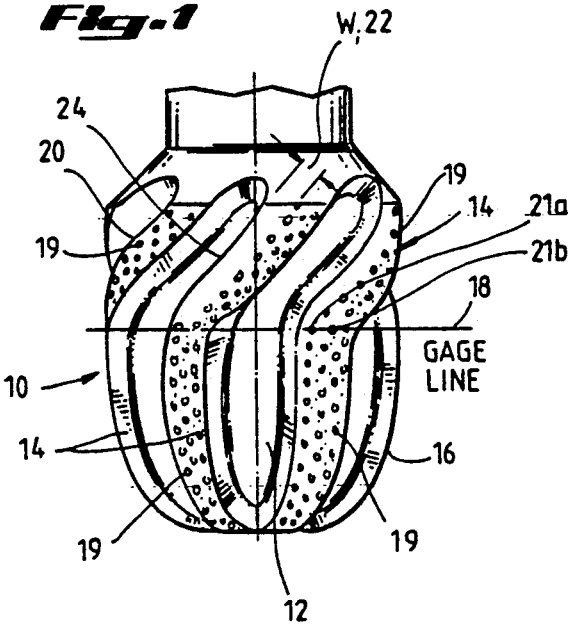
Fig. 2
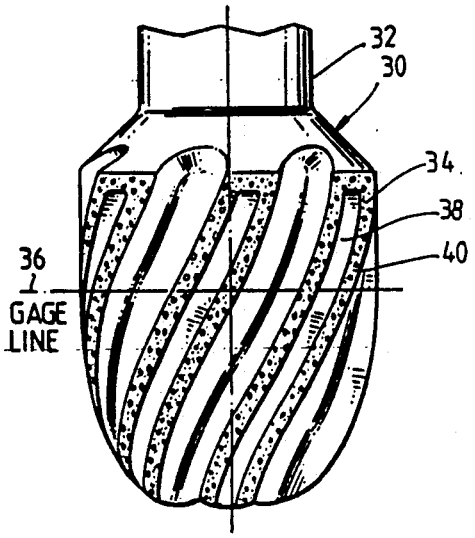
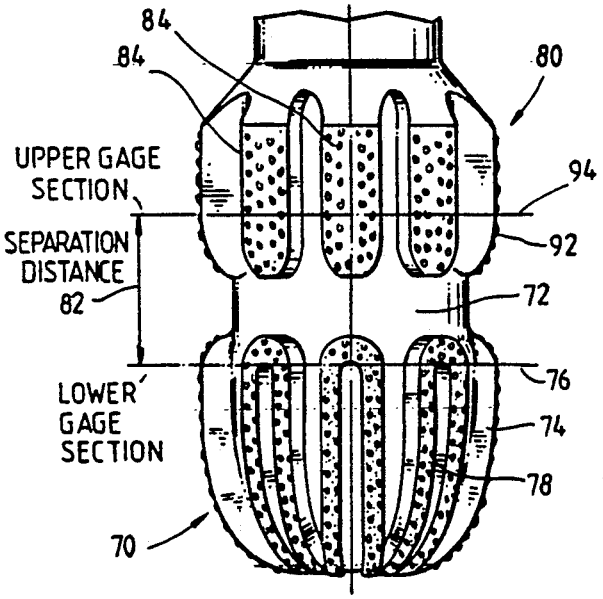
Fig. 4A
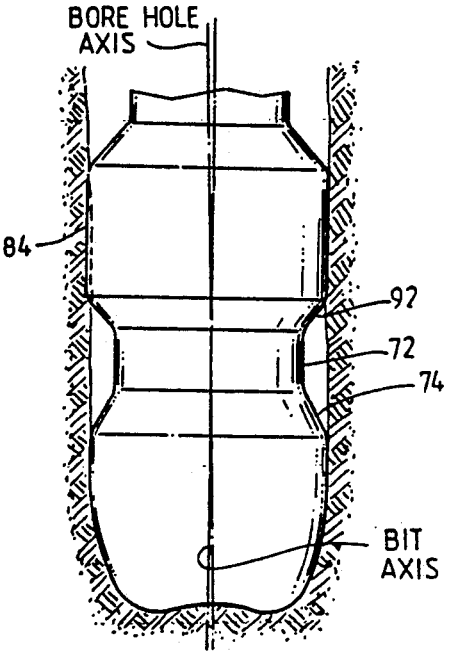
Fig. 4B

DRILL BIT WITH IMPROVED STEERABILITY

This application is a continuation of Ser. No. 07/146,290, filed Jan. 20, 1988, now abandoned.

The present invention relates generally to drill bits, and, more specifically, relates to drill bits conformed to provide improved steerability of the bit through unique design of the gage portions of the bit.

Conventional drill bits typically include one or more cutting surfaces to initially cut the gage of the borehole, i.e., the nominal diameter of the borehole. This cutting element may be one of any of the conventional types of cutting elements, such as a discrete cutting element, such as a surface-set natural diamond cutter, or a cutting or abrasive matrix, such as is formed by sintering small, grit-size diamonds in an abradable matrix.

Additionally, conventional drill bits typically include gage pads extending along the side of the bit to contact the sides of the borehole (as cut and defined by the gage cutting elements), to help maintain stability of the bit. Conventional gage pads typically provide relatively broad contact surfaces extending along 30–60% of the radial periphery of the bit. These gage pads are typically formed of diamond impregnated pads, of pads including vertical rows of diamonds (referred to as "broach stones") or of other wear-resistent materials such as tungstun carbide slugs. With the diamond impregnated pads, the diamond impregnation is utilized primarily to provide abrasion resistance to the bit gage pad as it rotates within the wellbore. The broach stone gage cutters are typically conformed to provide a minimal cutting capability to the gage pad. In summary, the primary purpose of gage pads in conventional bits is to maintain hole diameter and resist deviation from the borehole axis.

The drilling of angled or "deviated" wellbores has been known for many years. However, techniques for drilling deviated wellbores through navigational drilling techniques are becoming increasingly sophisticated. These navigational drilling techniques may benefit from drill bits with improved steerability, i.e., an ability to respond to directional loading forces applied by steering apparatus. Drill bits heretofore utilized for navigational drilling have, however, typically been of the conventional types as described above. However, such bits are better adapted, because of their gage design, for straight, rather than deviated, drilling of wellbores.

Accordingly, the present invention provides new and improved drill bits and methods for constructing drill bits whereby the bits will exhibit improved steerability relative to conventional designs, thereby providing optimal performance in directional and navigational drilling environments.

SUMMARY OF THE INVENTION

Drill bits in accordance with the present invention employ gage designs adapted to facilitate the bit's cutting an arcuate or curved path in a formation in response to side loading of the bit. This may be accomplished in different ways and with a variety of gage configurations intended to function as cutting means, in contrast to the prior art. Preferably, the gage of the bit will be adapted to minimize contact with the side of the borehole by a surface other than a cutting surface. Preferably, the gage portion of the bit will include cutting elements of a type adapted to cut the formations in which the bit is designed to operate. In another preferred embodiment, the bit includes two gage portions separated by a peripheral recess. This recess allows the bit to turn within the formation while the upper gage section will assure that the hole size is maintained throughout the turn while acting as a fulcrum to bit deviation.

BRIEF DESCRIPTION OF THE DRAWINGS

FIG. 1 depicts, in pertinent part, an exemplary embodiment of a drill bit in accordance with the present invention, depicted from a side view.

FIG. 2 depicts an alternative embodiment of a drill bit in accordance with the present invention, depicted from a side view.

FIG. 3A depicts the drill bit from a side view. FIG. 3B depicts the drill bit in a partial, bottom plan view.

FIGS. 4A–B depict another alternative embodiment of a drill bit in accordance with the present invention. FIG. 4A depicts the drill bit from a side view. FIG. 4B schematically depicts the drill bit of FIG. 4A in a earth borehole, illustrated in vertical section.

DETAILED DESCRIPTION OF A PREFERRED EMBODIMENT

Figure 3A:
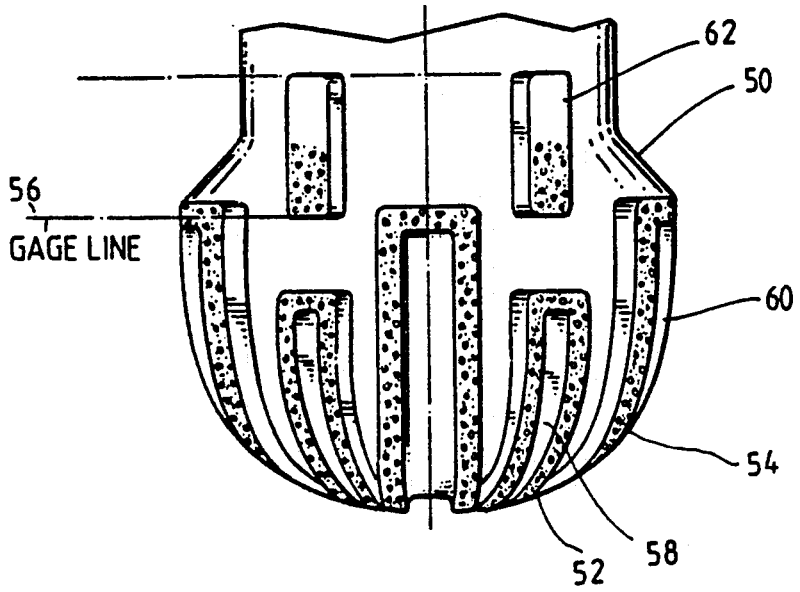
FIGS. 3A–B depict another alternative embodiment of a drill bit in accordance with the present invention.

Referring now to FIG. 1, therein is depicted a drill bit 10 in accordance with the present invention, illustrated from a side view. Drill bit 10 includes a body member, indicated generally at 12, which includes a plurality of cutting pads, indicated generally at 14. Body member 12 is preferably a molded component fabricated through conventional metal matrix infiltration technology. Drill bit 10 also preferably includes a shank with a threaded portion adapted to couple bit 10 into a drill string.

Cutting pads 14 each include a bottom cutting portion 16, generally that portion beneath gage line 18. Bottom cutting portions 16 are arranged in generally radial spokes, extending along the periphery of drill bit 10 from proximate the axial center of drill bit 10. Cutting pads 14 are depicted as including surface set natural diamond cutting elements, indicated generally and typically at 19. The depiction of these cutting elements is for illustrative purposes only, as any type of known or satisfactory cutting element may be used on drill bits in accordance with the present invention, including, for example, impregnated pads, thermally stable diamond cutters, poly-crystalline diamond cutters and tungsten carbide cutters. Unlike conventional bits, these cutting elements on bit 10 may preferably extend along the entire vertical length of cutting pads 14, both above and below gage line 18. The cutting elements 19 above gage line 18 may be of a different type than those on bottom cutting portions 16.

Cutting pads 14 each include a gage cutting portion 20, which is that portion extending above gage line 18. A plurality of cutting elements, for example, as indicated at **21*a* and 21*b*, are provided at gage line 18 to cut the nominal gage of the borehole. As can be seen in FIG. 1, above gage line 18, gage cutting portions 20 of cutting pads 14 depart from their radial/vertical placement on drill bit 10, and spiral around a portion of the periphery of drill bit 10. In the illustrated embodiment, the spiraled gage cutting portions 20 spiral around bit 10 to lag gage cutters 21*a*, 21*b* as bit 10 is rotated in a borehole. However, portions 20 may also lead gage cutters 21*a*, 21*b***.

Additionally, in the embodiment of FIG. 1, a gap width (w), indicated generally at 22, is placed between the leading edge 24 of each gage cutting portion 20 and the exposure of cutting elements on that cutting portion 20. As bit 10 is rotated in a formation to drill the formation, as gage cutters 21*a*, 21*b* cut the gage of the formation, bit 10 will be progressing downwardly, penetrating the formation. Accordingly, cutters proximate leading edge 24 of the gage cutting portion 20 would not typically be providing actual cutting of the formation, but would merely be proceeding in the path of gage cutters 21*a*, 21*b*. Accordingly, in this exemplary embodiment, width (w) 22 is provided, thereby offsetting cutting elements 19 on spiraled gage cutting portions 20 where cutting elements 19 will be intersecting more of the formation. Offset width (w) 22 may be adapted for particular bits and particular cutter configurations, and may be functionally related to the depth of cut of bottom cutting portion 16 and the expected depth of penetration of the bit per revolution within the formation. Alternatively, offset width 22 may be omitted and cutting elements can be provided along the entire surface of spiraled gage cutting portion 20.

In operation within a well, drill bit 10 will exhibit improved steerability due to the contours of gage cutting portions 20 of cutting pads 14. This improved steerability can best be explained by comparison to a bit having vertically extending gage portions, such as if the gage portions of drill bit 10 continued the radial extension of bottom cutting portion 16. When a drill bit is directed in a formation to drill a deviated wellbore, the drill bit is deflected within the established portion of the wellbore as it cuts along an arc. With a conventional drill bit having large, vertically extending, gage pads, the entire length of the gage pads will simultaneously contact a generally vertical line on the side of the formation. This line may be envisioned as lying along the innermost portion of the desired arcuate wellbore. As a result, extremely high sideloading on the bit is required to cause this large surface to cut into the formation. This is true even where the gage pads include broach stones, as the entire length of the stones will be contacting the formation wall. During the drilling of an arc, this side loading requirement must continually be overcome as the bit is directed along a radius.

In contrast, when drill bit 10 is directed along a radius in a formation, only a small portion, theoretically essentially a point contact, is made between gage cutting portion 20 and a similar generally vertical line along the sidewall of the borehole. Accordingly, gage cutting portion 20 does not serve as a standoff to prevent lateral cutting of bit 10, but is free to cut laterally in the formation. As bit 10 rotates and penetrates the formation, a new, vertically offset, point of gage cutting portion 20 is brought into contact with uncut formation material along the conceptualized path of the borehole. This new point is then free to cut the formation to which it is exposed, as are following points in turn. As a result, the side loading necessary to cause drill bit 10 to cut the sidewall of the borehole is substantially reduced.

Referring now to FIG. 2, therein is depicted the lower, cutting, portion of an alternative embodiment of a drill bit 30 in accordance with the present invention. Drill bit 30 again includes a body section 32 and a plurality of cutting pads 34. Cutting pads 34 are arranged in spirals around respective portions of the periphery of drill bit 30. Each cutting pad 34 may be a generally continuous land which extends from proximate the longitudinal axis of bit 30 to substantially above gage line 36. As illustrated by way of example and not of limitation, each continuous land 34 surrounds an aperture 38 which directs a dedicated hydraulic flow regime across the cutting elements on cutting pads 34. The use of a dedicated hydraulic flow regime on drill bit cutting pads is disclosed in the co-pending application of Gordon Tibbitts filed the same day as the present application and entitled "Methods and Apparatus for Establishing Hydraulic Flow Regime in Drill Bits," and assigned to the assignee of the present invention.

Gage cutting portions 40 of continuous lands 34 (those portions above gage line 36), again may include cutting elements of the type as utilized on cutting pads 34 beneath gage line 36, although different types of cutting elements may also be employed. Gage cutting portions 40 of drill bit 30 function in a manner similar to that described with respect to gage cutting portions 20 of drill bit 10 of FIG. 1. The spiraled arrangements of cutting lands 34, particularly along gage cutting portions 40 minimize the side loading on bit 30 required to allow bit 30 to deflect within a wellbore.

Figure 3B:
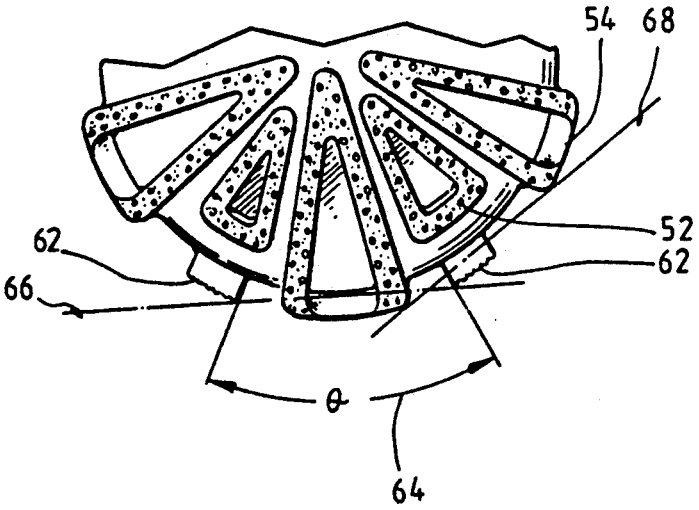

Referring now to FIGS. 3A–B, therein is depicted another alternative embodiment of a drill bit 50 in accordance with the present invention. Drill bit 50 includes a plurality of bottom cutting pads 52, 54 which extend generally radially along the periphery of drill bit 50. Cutting pads 52 cut primarily along the bottom surface when drill bit 50 is operated within a formation, while cutting pads 54 extend to the gage 56 of bit 50. Cutting pads 52 thus extend from proximate the longitudinal axis of drill bit 50 to generally vertical above gage line 56. Each cutting pad 52, 54 preferably exhibits a generally triangular form along the periphery of drill bit 50. Each cutting pad 52, 54 may again, as in bit 30 of FIG. 2, be a generally continuous pad surrounding a central aperture 58, 60, respectively, to provide a dedicated hydraulic flow across each cutting pad 52, 54.

Drill bit 50 further includes discrete gage cutting pads 62 which are preferably disposed in generally radial alignment with cutting pads 52. Gage cutting pads 62 preferably include cutting elements suitable for cutting the formations which bottom cutting pads are designed to cut. Preferably, each gage cutting pad 62 will have cutting elements arranged primarily on the lower portion, for example the lower two-thirds, of the pad 62. This allows the lower portion of the gage cutting pad 62 to cut freely into the formation, while the upper portions will tend to function as a stand-off for bit 50. The upper portions of gage cutting pad 62 will preferably be formed of an abrasion resistant material, such as a diamond impregnated matrix, as discussed earlier herein.

The distribution and sizing of discrete gage cutting pads 62 establishes a relatively wide angle ($\phi$) 64 between adjacent leading and trailing edges of neighboring gage cutting pads 62. Each gage cutting pad 62 extends upwardly from a position at or below gage line 56.

In operation, as drill bit 50 is rotated and deflected within a borehole, these discrete gage cutting pads 62 will facilitate optimal steerability for bit 50. As drill bit 50 begins to cut an arc, the surfaces which normally tend to oppose deflection of the bit are gage cutting pads 62. However, because of the spacing of gage cutting pads 62, there is a distance around the periphery of drill bit 50, as a result of the angular spacing represented by angle ($\phi$) 64, which will not oppose deflection of bit 50. By way of illustration only, drill bit 50 may be considered as being capable of deflecting around a fulcrum defined by the adjacent leading and trailing edges of adjacent gage cutting pads 62, as indicated generally along dashed line 66 in FIGS. 3A–B or around a fulcrum 68 defined by the corresponding edges of cutting pads 54. Accordingly, as drill bit 50 is deflected and rotated within the formation, each pad cutting the gage dimension, 54, 62, will take a progressively deeper cut to the inner side of the arc trajectory, facilitating the cutting of the arc. Further, as the full dimension of the gage cutting pads 62 traverses downwardly through the formations, they will continue to cut the gage dimension.

The cooperative arrangement of cutting pads 54 extending to the gage of bit 50, and the spaced distribution of relatively narrow gage cutting pads 62, as depicted on drill bit 50, serves to concentrate side loading on drill bit 50 when drill bit 50 is operated in a formation such that the side load is applied primarily to the side and gage cutting portions of the bit encountering the formation. Accordingly, the bit does not provide an undesirable resistance to steering along a desired nonlinear path, as is the case with prior art bits.

Referring now to FIGS. 4A and 4B, therein is depicted another alternative embodiment of a drill bit 70 in accordance with the present invention. Drill bit 70 again includes a body member 72 and a plurality of cutting pads 74. Cutting pads 74 each preferably extend radially, and may eventually be vertical, from proximate the longitudinal axis of drill bit 70 to lower gage line 76 of bit 70. Each cutting pad 74 again may surround a central aperture 78 to provide dedicated hydraulic flow across cutting pad 74.

Drill bit 70 also includes an upper gage section, indicated generally at 80. Upper gage section defines an upper gage line 94 which is separated from lower gage line 76 by a separation distance 82. Upper gage section 80 includes a plurality of vertical gage cutting pads distributed around the periphery of drill bit 70. The portions of gage cutters 84 within separation distance include a radius 92 terminating at gage dimension. Upper gage section cutters are depicted as including cutting elements across their entire surface. In some configurations, it may be desirable to include cutting elements only proximate the lower portion of gage cutting pads 84 and to establish the upper portion of each gage pad 84 as merely a diamond impregnated pad, as previously described herein.

When drill bit 70 is operated to drill a nonlinear borehole path, separation distance 82 provides a relief to facilitate deflection of bit 70 and to thereby facilitate the drilling of the nonlinear path, because the cutting pads 74 do not have excessive resistance to side loading as in conventional bits, and gage cutting pads 84 provide a contact point against which bit 70 may turn. Since lower cutting pads 74 extend only a minimal distance above lower gage line 76, when side load forces are placed on drill bit 70, there is relatively minimal resistance to lateral cutting of the formation. Because of the dimensional relief provided by separation distance 82, upper gage line 94 may be considered the location of a fulcrum on the interior of the arc around which drill bit 70 can deflect. As more and more of cutting pads 84 encounter the formation, the resistance to deflection of drill bit 70 within the formation will increase. The separation distance, therefore, in combination with the number and size of upper gage cutting pads 84 and the cutting element distribution on each pad 84 will cooperatively serve to define a radius which drill bit 70 can optimally traverse. It will be apparent that the dimension of separation distance may vary between different embodiments of bits. However, by way of example only, separation distances of from 1.25 inches to 3 inches may potentially advantageously be utilized in embodiments of bit 70. Although upper gage section 80 of drill bit 70 is depicted as having vertically arranged cutting pads, these cutting pads could easily be arranged in spiraled or other curvilinear shapes along their respective portions of the periphery of drill bit 70.

It will be understood by one of ordinary skill in the art that references herein to cutting or holding a gage dimension while the bit is traversing a nonlinear path are not meant to imply that the borehole is of perfect gage, or even symmetrical. Turning a bit will normally result in an oversized, generally elliptical cross-section, hole, with its longer dimension parallel to the direction of the turn. In some instances, as for example where the turn is not entirely planar, a generally circular but oversized hole (in all radial dimensions) may result.

It will also be appreciated that the use of the present invention in a bit may also be employed to reduce, enhance or otherwise control the bit's tendency to "sidetrack" to the right or left by varying its resistance to lateral displacement in the borehole.

Many modifications and variations may be made in the techniques and structures described and illustrated herein without departing from the spirit and scope of the present invention. For example, gage portions may be utilized which include relatively wide spiraled cutting pads to provide some nominal resistance to side-loading to prevent inadvertent deviation of the bit. Additionally, conventional large, predominantly non-cutting gage pads may be utilized on a bit in conjunction with spiraled and/or cutting gage pads as described herein. Also, different cutting elements may be employed on various cutting pads. Reverse-directed spiral pads, discontinuous spirals or spirals disposed at varying angles may also be employed. Accordingly, it should be readily understood that the embodiments described and illustrated herein are illustrative only and are not to be considered as limitations on the present invention.

We claim:

1. A drill bit having improved steerability for drilling deviated portions of boreholes in earth formations, comprising:

(a) a body member;

(b) a plurality of cutting elements on said body member adapted to penetrate said formation and form a borehole when said drill bit is rotated within said formation; and (c) a first gage cutting section on said drill bit, said first gage cutting section having a plurality of gage cutting portions peripherally spaced on the first gage cutting section of the bit;

(d) a second gage cutting section on said drill bit, said second gage cutting section having a plurality of gage cutting portions peripherally spaced on the gage cutting section of the bit, said gage cutting portion of said second gage cutting section being longitudinally spaced from gage cutting portions of said first gage cutting section, thereby defining a gap between longitudinally adjacent gage cutting portions of said first and second gage cutting sections, whereby at least one gage cutting portion of said first and second gage cutting sections functions as a fulcrum around which said bit may deflect, said longitudinal spacing facilitating deflection of said bit by enhancing the lateral cutting capability of said bit.

2. The drill bit of claim 1, wherein said second gage cutting section on said drill bit comprises surface set diamonds as cutting elements.

3. The drill bit of claim 1, wherein said plurality of cutting elements comprises surface set diamonds.

4. A drill bit for drilling generally deviated portions of a borehole in an earth formation, comprising:

(a) a body member;

(b) a bottom cutting surface adapted to penetrate said formation when said drill bit is rotated within said formation, said bottom cutting surface including a plurality of cutting elements, said bottom cutting surface further adapted to cut the gage diameter of said borehole along at least a first gage line; and (c) at least one gage cutting section on said drill bit, said gage cutting section having a plurality of gage cutting surfaces peripherally spaced on the gage cutting section of the bit and being adapted to cut said gage diameter of said borehole along at least a second gage line, said first and second gage lines separated from one another by a recess whereby one of said first or second gage lines functions as a fulcrum around which said bit may deflect to provide improved lateral cutting of the formation, allowing said first and second gage sections to enhance said steerability of said bit.

5. The drill bit of claim 4, wherein at least a portion of said plurality of gage cutting surfaces are generally vertically arranged on said drill bit.

6. The drill bit of claim 4, wherein said gage cutting section on said drill bit comprises cutting pads having surface set diamonds as cutting elements.

* * * * *